US009481496B2

(12) United States Patent
Cottle et al.

(10) Patent No.: US 9,481,496 B2
(45) Date of Patent: Nov. 1, 2016

(54) CHILD RESISTANT CONTAINER

(71) Applicant: SWEDISH MATCH NORTH EUROPE AB, Stockholm (SE)

(72) Inventors: David Cottle, Bristol (GB); Tom Collings, Bristol (GB); Jesper Svahn, Gothenburg (SE)

(73) Assignee: Swedish Match North Europe AB, Stockholm (SE)

( * ) Notice: Subject to any disclaimer, the term of this patent is extended or adjusted under 35 U.S.C. 154(b) by 134 days.

(21) Appl. No.: 14/508,272

(22) Filed: Oct. 7, 2014

(65) Prior Publication Data

US 2015/0027915 A1 Jan. 29, 2015

Related U.S. Application Data

(63) Continuation of application No. 13/879,636, filed as application No. PCT/SE2011/051236 on Oct. 17, 2011, now Pat. No. 8,875,877.

(60) Provisional application No. 61/394,114, filed on Oct. 18, 2010.

(30) Foreign Application Priority Data

Oct. 18, 2010 (SE) ..... 1051086

(51) Int. Cl.
*A24F 15/00* (2006.01)
*B65D 85/10* (2006.01)
(Continued)

(52) U.S. Cl.
CPC ..... *B65D 50/04* (2013.01); *A24F 15/00* (2013.01); *B65D 50/046* (2013.01); *B65D 2215/02* (2013.01)

(58) Field of Classification Search
CPC .... B65D 50/045; B65D 85/10; B65D 50/04; B65D 50/046; B65D 2215/02; A61J 1/035; A24F 15/02; A24F 15/00; E05B 73/0023
USPC ..... 206/1.5, 265–267, 77.1, 482, 538, 560, 206/565, 263, 236, 540, 530, 557, 528, 464, 206/37
See application file for complete search history.

(56) References Cited

U.S. PATENT DOCUMENTS 1,326,885 A 12/1919 Wales
3,072,276 A 1/1963 Nichols
(Continued)

FOREIGN PATENT DOCUMENTS

DE 10355803 6/2005
EP 1088769 4/2001
(Continued)

OTHER PUBLICATIONS

International Search Report dated Sep. 11, 2006 from PCT Application PCT/CA2005/001860.
(Continued)

*Primary Examiner* — Jacob K Ackun
*Assistant Examiner* — Rafael Ortiz
(74) *Attorney, Agent, or Firm* — Knobbe Martens Olson & Bear LLP

(57) ABSTRACT

The object of the present invention is to provide a child resistant container for nicotine products. The container comprises latching elements (8, 25) adapted to interlock with cooperating latching elements (9, 27) when said lid (3) is pushed onto a said base (2) to retain said lid (3) to said base (2). The latching elements (8, 25) are further adapted to disengage from said cooperating latching elements (9, 27) when a simultaneous force is exerted on all releasable latching arrangements (6, 7, 12, 13) by two hands of a user or the like.

27 Claims, 11 Drawing Sheets

(51) Int. Cl.
*B65D 85/12* (2006.01)
*B65D 50/04* (2006.01)

(56) References Cited

U.S. PATENT DOCUMENTS

| | | | | |
|---|---|---|---|---|
| 3,749,230 | A | 7/1973 | Foster | |
| 3,888,350 | A | 6/1975 | Horvath | |
| 4,126,224 | A | 11/1978 | Laauwe et al. | |
| 4,219,116 | A | 8/1980 | Borkan | |
| 4,344,646 | A | 8/1982 | Michel | |
| 4,375,858 | A | 3/1983 | Shah et al. | |
| 4,511,032 | A | 4/1985 | Bush | |
| 4,588,097 | A | 5/1986 | Hauser | |
| 4,746,008 | A * | 5/1988 | Heverly | B65D 55/02 206/1.5 |
| 4,969,573 | A | 11/1990 | Dupuis et al. | |
| 5,033,634 | A | 7/1991 | Batchelor et al. | |
| 5,137,260 | A | 8/1992 | Pehr | |
| 5,346,069 | A | 9/1994 | Intini | |
| 5,356,017 | A | 10/1994 | Rohr et al. | |
| 5,575,399 | A | 11/1996 | Intini | |
| 5,641,065 | A * | 6/1997 | Owens | B65D 45/20 206/363 |
| 5,725,123 | A | 3/1998 | Otto-Nagels | |
| 5,740,938 | A | 4/1998 | Hofmann et al. | |
| 5,788,105 | A | 8/1998 | Foos | |
| 5,979,680 | A | 11/1999 | Farside | |
| 6,021,901 | A | 2/2000 | Wolfe | |
| 6,173,838 | B1 | 1/2001 | Brozell | |
| 6,832,686 | B2 | 12/2004 | Donegan | |
| 7,549,541 | B2 | 6/2009 | Brozell et al. | |
| 2002/0056652 | A1 | 5/2002 | Kawamura et al. | |
| 2002/0185404 | A1 * | 12/2002 | Donegan | B65D 77/02 206/531 |
| 2004/0195241 | A1 * | 10/2004 | Stull | B65D 41/0414 220/326 |
| 2005/0183981 | A1 | 8/2005 | Gelardi | |
| 2007/0023317 | A1 | 2/2007 | Brozell et al. | |
| 2007/0284372 | A1 | 12/2007 | Gnepper | |
| 2009/0152134 | A1 | 6/2009 | Katsis | |
| 2009/0255842 | A1 | 10/2009 | Brozell et al. | |
| 2009/0283437 | A1 * | 11/2009 | Angelucci | A61J 7/04 206/530 |
| 2010/0012534 | A1 | 1/2010 | Hoffman | |
| 2010/0154353 | A1 | 6/2010 | Cesa et al. | |
| 2010/0243488 | A1 | 9/2010 | Gibson | |
| 2011/0303566 | A1 | 12/2011 | Gibson et al. | |
| 2013/0112586 | A1 * | 5/2013 | Hawry | B65D 25/10 206/528 |
| 2013/0112588 | A1 * | 5/2013 | Flood | A61J 1/03 206/531 |

FOREIGN PATENT DOCUMENTS

| | | |
|---|---|---|
| EP | 2011743 | 1/2009 |
| GB | 1152096 | 5/1969 |
| GB | 1502258 | 3/1978 |
| GB | 1511664 | 5/1978 |
| GB | 2319244 | 5/1998 |
| WO | WO 01/55001 | 8/2001 |
| WO | WO 02/06135 | 1/2002 |
| WO | WO 2005/021398 | 3/2005 |
| WO | WO 2005/102849 | 11/2005 |
| WO | WO 2007/065240 | 6/2007 |

OTHER PUBLICATIONS

European Search Report dated Jan. 22, 2008 from European Application No. EP 2011743.

European Search Report dated Mar. 22, 2000 from European Application No. EP 1088769.

International Search Report dated May 27, 2005 from PCT Application PCT/AU2005/000547.

Jan. 10, 2012 International Search Report for corresponding Application No. PCT/SE2011/051236.

Mar. 22, 2000 European Search Report for corresponding Application No. EP 1088769.

Jan. 22, 2008 European Search Report for corresponding Application No. EP 2011743.

Sep. 11, 2006, International Search Report for corresponding Application No. PCT/CA2005/001860.

May 27, 2005 International Search Report for corresponding Application No. PCT/AU2005/000547.

* cited by examiner

CHILD RESISTANT CONTAINER

CROSS REFERENCE TO RELATED APPLICATIONS

This application is a continuation of U.S. application Ser. No. 13/879,636 filed May 30, 2013, which is a U.S. National Phase Application of PCT International Application Number PCT/SE2011/051236, filed on Oct. 17, 2011, designating the United States of America and published in the English language, which is an International Application of and claims the benefit of priority to Swedish Patent Application No 1051086-5, filed on Oct. 18, 2010, and U.S. Provisional Application No. 61/394,114, filed on Oct. 18, 2010. The disclosures of the above-referenced applications are hereby expressly incorporated by reference in their entireties.

TECHNICAL FIELD

The present invention relates to child resistant containers for nicotine products, nicotine replacement therapy products and the like.

BACKGROUND ART

Packages for products of a nature that are dangerous to children may be childproofed in various ways. One way of childproofing a package is to provide it with a dexterity threshold for opening that is beyond a child's capabilities.

Document GB1152096A discloses a prior art child resistant container wherein the user is required to use two fingers of each hand to open the container. This is performed by the pressing the flat side wall portions of the base of the container towards each other to reduce the distance between the part cylindrical wall portions, and simultaneously pressing opposed portions of the cylindrical wall of the lid towards each other, to deform the lid to an elliptical shape of which the diameter across the lips of the body is increased.

The problem with the solution according to the prior art is that the container must be manufactured in a relatively elastic material to enable sufficient deformation of the wall to attain the position where said container can be opened.

A further problem is that the opposed pressing points of the base for deforming said base are substantially in the same plane as the opposed pressing points of the lid, which leads to a situation where the container possibly could be opened by only two fingers by simply grasping and compressing two opposite sides of the closed container.

Still a further problem is that the locking mechanism of the container requires the base to be cylindrical with walls comprising flat side portions, and the lid to be cylindrical. Said form and geometry of the container is sometimes not desired.

There is thus a need for an improved child resistant container removing the above mentioned disadvantages, where a childproof container is provided that has a high dexterity threshold and yet remains relatively easy for an adult to open.

SUMMARY OF THE INVENTION

The object of the present invention is to provide an inventive child resistant container for nicotine products, nicotine replacement therapy products and the like, where the previously mentioned problems are at least partly overcome. Said inventive container comprises a base including a bottom wall and a peripheral base flange extending from said bottom wall, a detachable separate lid including a top wall and a peripheral lid flange extending from said top surface, wherein said lid flange is adapted to be attached over and around at least an upper portion of said base flange to close said container.

The object of the invention is achieved by the features of the characterising portion of claim 1, wherein the child resistant container further comprises a first pair of releasable latching arrangements and a second pair of releasable latching arrangements. Each of the releasable latching arrangements comprises a latching element provided on said lid, a cooperating latching element provided on said base, and a release actuation surface. The latching elements are adapted to interlock with said cooperating latching elements when said lid is pushed onto said base to retain said lid to said base. The latching elements are further adapted to disengage from said cooperating latching elements when an inward force is exerted on said release actuation surfaces. The first pair of releasable latching arrangements are arranged on substantially opposite sides of said container, wherein the second pair of releasable latching arrangements are arranged on substantially opposite sides of said container. There is an angle $\alpha$ between a first plane passing through said first pair of releasable latching arrangements and a second plane passing through said second pair of releasable latching arrangements. Each of the first- and second planes are perpendicular to a third plane defined by said bottom wall. The angle $\alpha$ is within the range of from 70° up to and including 110°, such that simultaneous force exerted on all of said releasable latching arrangement by two hands of a user or the like is required to open said child resistant container.

One advantage of the invention is that the device is child proof due to its complexibility for children, but easy for an adult to use due to its simplicity for adults "knowing the trick".

Further advantages are achieved by implementing one or several of the features of the dependent claims. For example, the angle $\alpha$ is preferably within the range of 80° to 100°, more preferably within the range of 85° to 95°, and most preferably approximately 90°. The stated angles give the advantage that one hand, and at least two fingers, have to be used on each side of the container.

Another example is that, the first and second pair of releasable latching arrangements could be formed as snap latches. One advantage of this example is that the lid is locked automatically when closing the container.

Further detail examples of the invention are explained below, with the common advantage that the container can be opened by gripping the lid with one hand and the base with the other hand and then simultaneously releasing the lock mechanism and subsequently separating the lid from the base using the same hand grip. One additional advantage is that the container does not show any obvious signs that inherently would give a child information on how to open the container, but the container can only be opened if the user is informed about how the container should be manipulated in order to be opened.

The release actuation surface of each of said first pair of latching arrangements could be provided on said base flange, and said release actuation surface of each of said second pair of latching arrangements could be provided on said lid flange.

The latching elements may be located on said lid flange and the corresponding latching elements may be located on said base flange or on an extension of said bottom wall outside said base flange. The lid flange, said base flange, and the location of said release actuation surfaces may be adapted such that said lid flange and base flange will at least partly deform inwardly upon inward force exerted on said release actuation surfaces, resulting in disengagement of said latching elements from said corresponding latching elements.

The latching element of each of said second pair of releasable latching arrangements may comprise at least one pivotable element comprising said release actuation surface, wherein an inward force exerted on said release actuation surface will cause said pivotable element to pivot inwardly, resulting in disengagement of said latching element from said corresponding latching element.

The pivotable element may be formed of a hinged flap in the shape of a circular or elliptical segment, which is attached along an upper portion of the lid flange, and wherein a circumferential end of the lid flange does not form part of said hinged flap.

The latching element of each of said second pair of releasable latching arrangements may be formed as a snap-latch cantilever beam arranged at a lower portion of said pivotable element.

The snap-latch cantilever beams may comprise a first catch surface adapted to interlock with a second catch surface of said corresponding latching element, and wherein said second pair of releasable latching arrangements are self-locking for improved safety.

The first and second catch surfaces advantageously form an angle of ≥5° with respect to said third plane, and more preferably said first and second catch surfaces form an angle of ≥10° with respect to said third plane.

The latching element of each of said first pair of releasable latching arrangements may be formed as a latching projection arranged on an inner side of said lid flange, and said cooperating latching element of each of said first pair of releasable latching arrangement may be formed as a latching recess arranged on an outer side of said base flange.

The base flange and said lid flange have an essentially rectangular configuration defining four side walls of said container, wherein one releasable latching arrangement may be provided, preferably centrally, on each of said side walls.

The lid flange may completely cover said base flange around at least part of a circumference of the child resistant container, such that a split line between said lid and said base is at least partly concealed for improved child resistance.

The lid flange may completely cover said base flange at least in the region of said second pair of releasable latching arrangements, and said release actuation surfaces of said base flange may be clearly visible below an end of said lid flange in a closed position of said child resistant container.

The above described examples have the advantage that the container can be opened by gripping the lid with one hand and the base with the other hand and then simultaneously releasing the lock mechanism and subsequently separating the lid from the base using the same hand grip.

BRIEF DESCRIPTION OF THE DRAWINGS

The invention will be described in greater detail below with reference to the preferred embodiment shown in the drawings, in which FIG. 1 schematically shows a perspective view of the container according to the invention in a closed configuration.

DETAILED DESCRIPTION

In the following only one embodiment of the invention is shown and described, simply by way of illustration of one mode of carrying out the invention. The shallow and generally rectangular container according to the invention forming an enclosure for nicotine products, nicotine replacement therapy products and the like. The container is however suitable for many other products requiring a high dexterity threshold as well.

The term "child resistant" in this application is considered to denote that virtually all small children, for example up to four years old, are not capable of reading and understanding instructions marked for adults on containers and do not possess the strength or dexterity required for opening of the container. On the other hand, a normal adult is capable by using both hands to apply the combination of forces needed to open the container.

Figure 1:
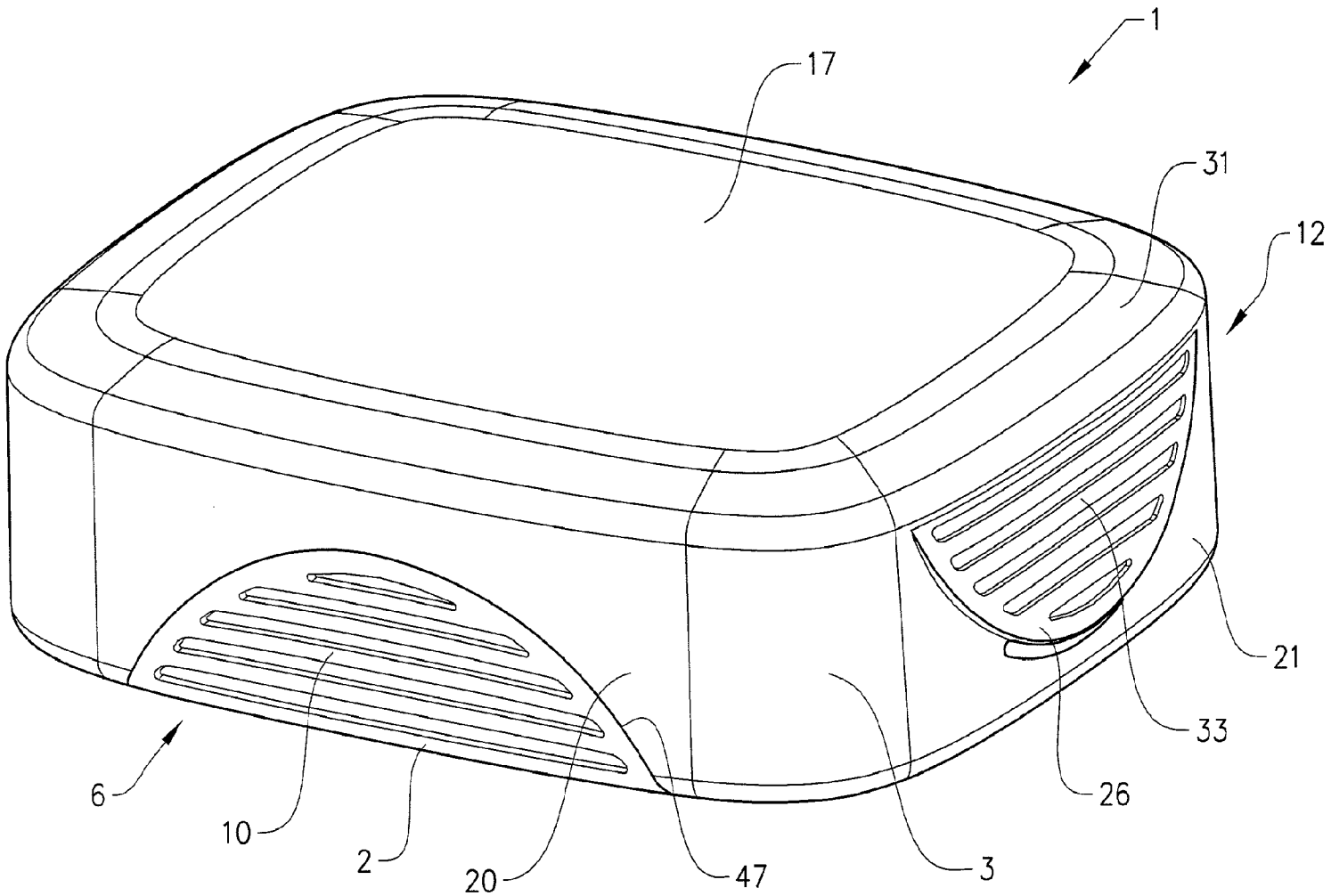
Figure 2:
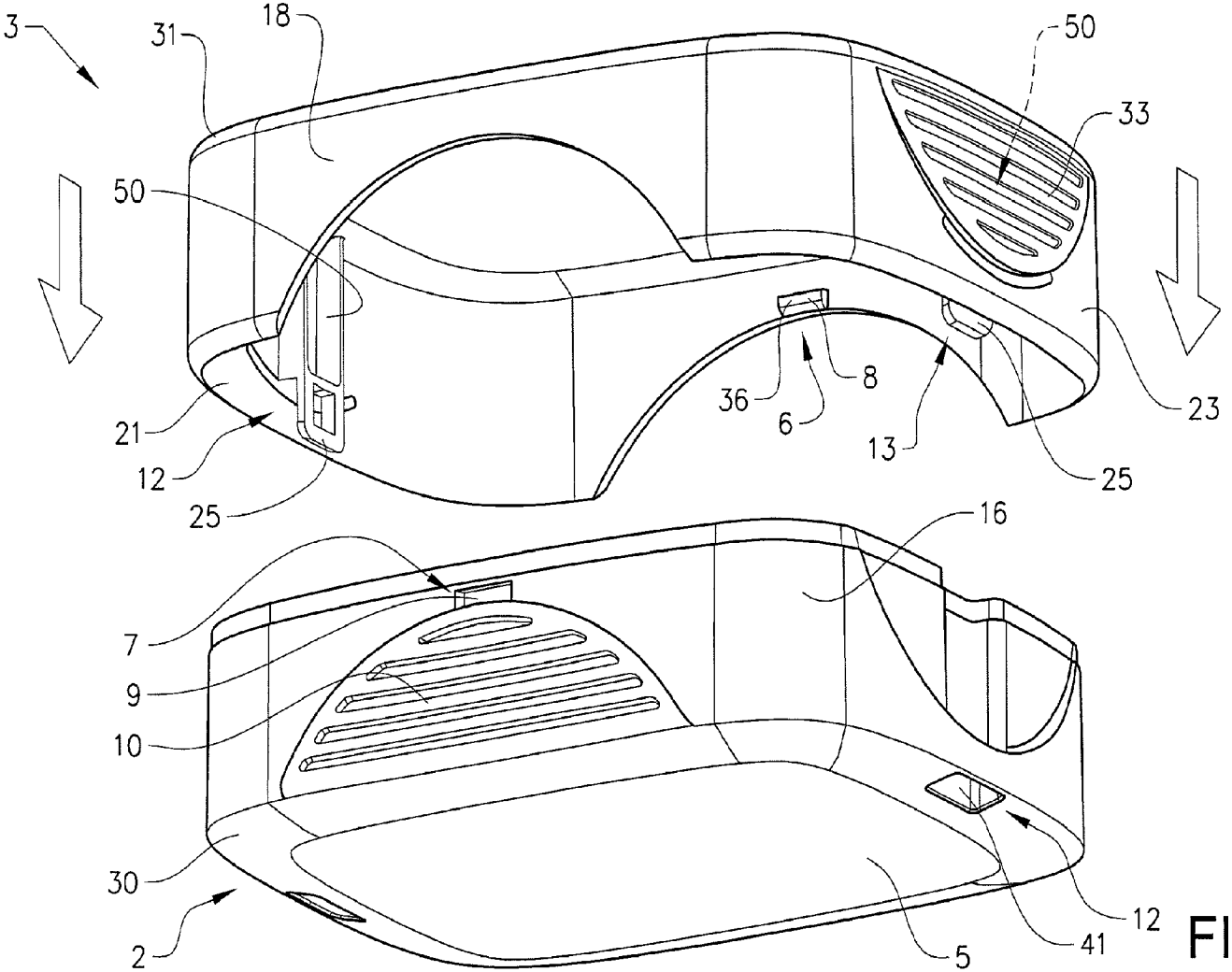
FIG. 2 schematically shows a perspective view of the container according to the invention in an open configuration.

FIGS. 1 and 2 show a general view of the inventive container 1 in a closed respective open configuration. The container 1 comprises a substantially rectangular base 2 including a planar bottom wall 5 and a peripheral base flange 16 extending upwardly from said bottom wall 5, when said bottom wall 5 is arranged flat on a horizontal surface, and a detachable lid 3 including a top planar wall 17 and a peripheral lid flange 18 extending downwardly from said top planar wall 17. Since said lid 3 is completely detachable from said base 2 in the opened state of the container 1, all sides of the container 1 can be used for improving the child resistance of the container 1, besides simplifying manufacturing and reliability of the container 1 due to lack of any elaborate hinge device securing the lid 3 to the base 2, susceptible to malfunction.

Figure 3:
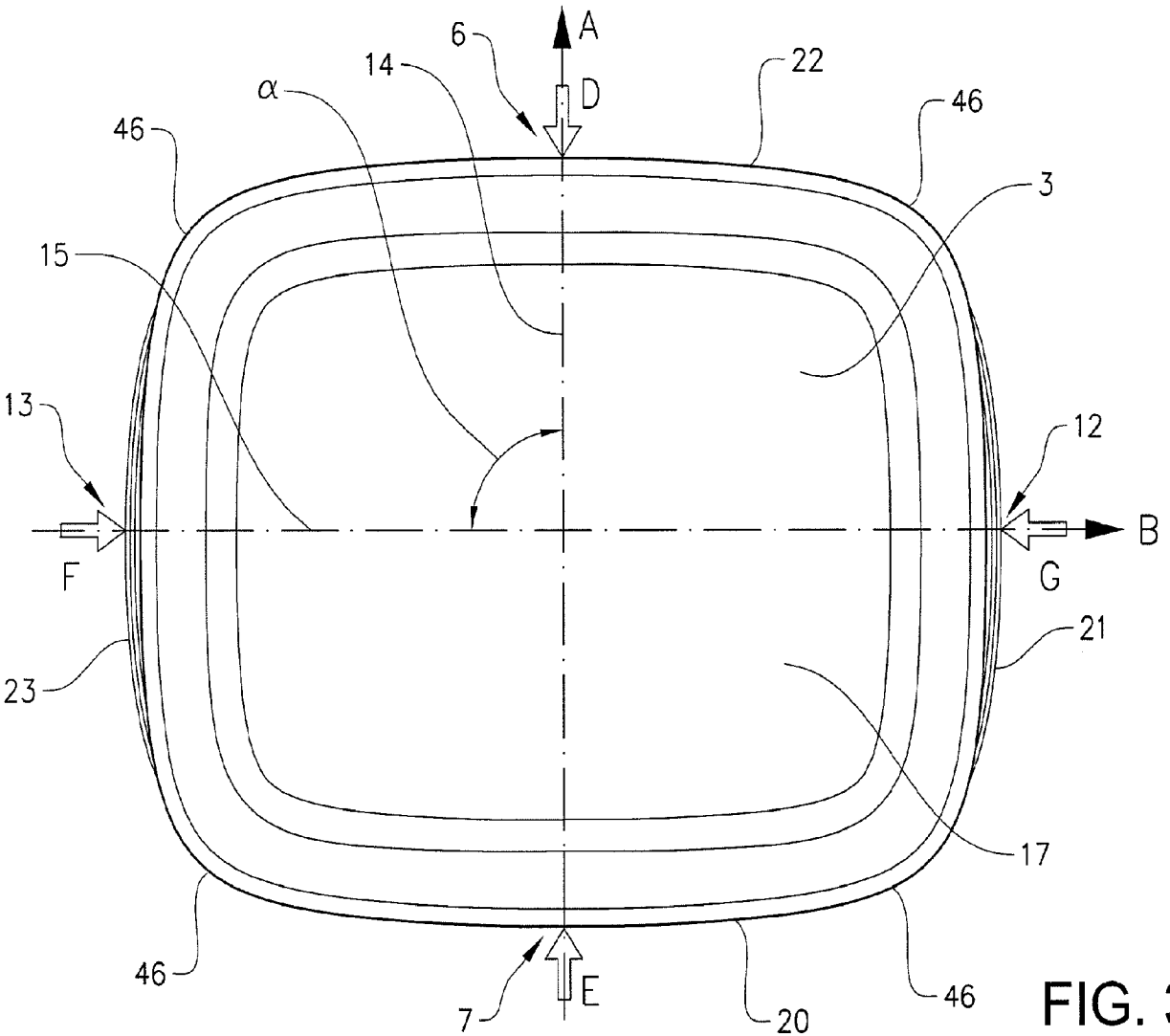
FIG. 3 schematically shows the container according to the invention viewed from above.
Figure 4:
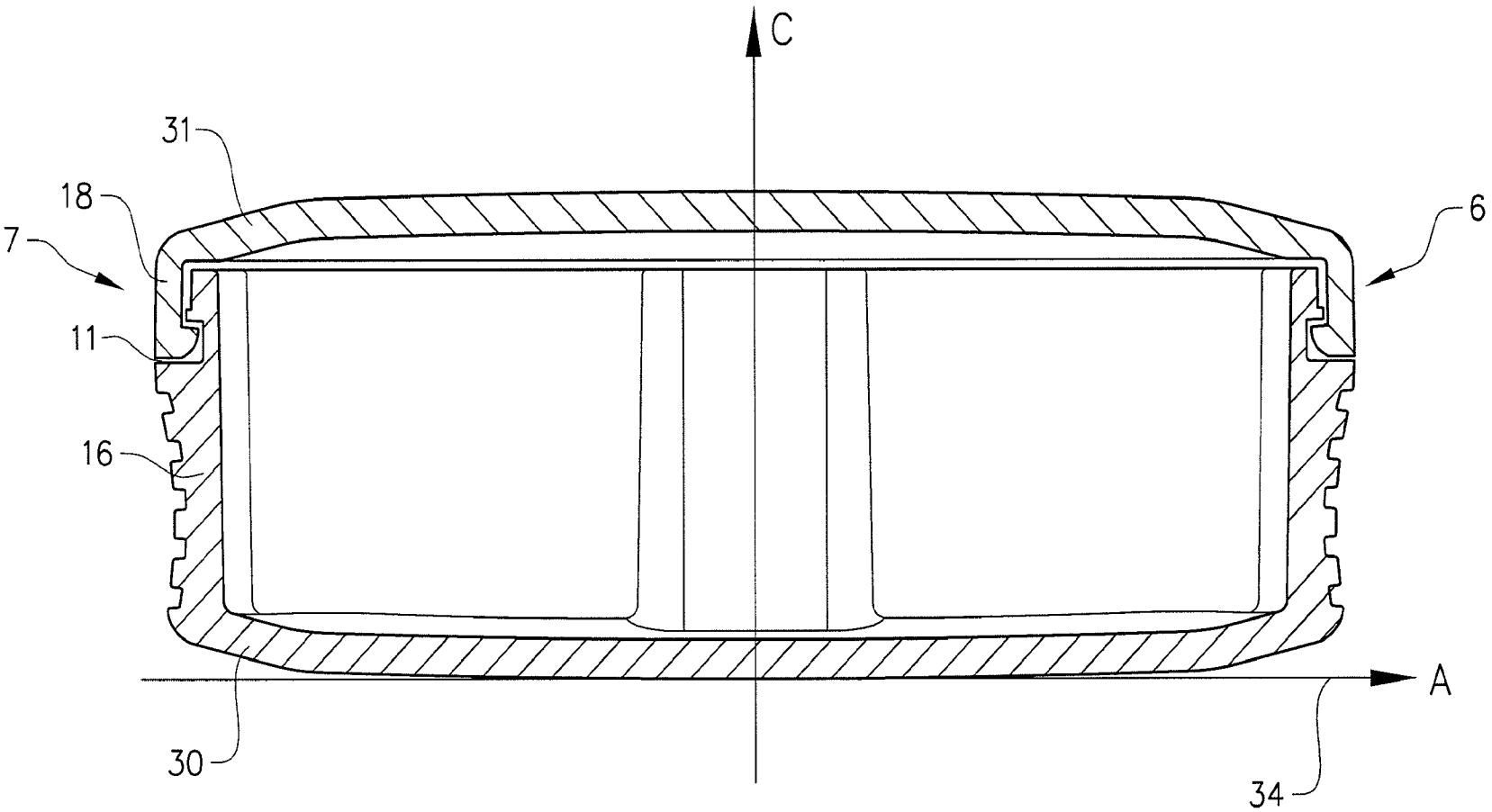
FIG. 4 schematically shows the container according to the invention viewed from the side.

In FIGS. 3 and 4, axis B defines a longitudinal axis, axis A defines a transverse axis, and axis C defines a vertical axis of the container 1. Hereinafter, the terms "upper" or "top" refer to the region or parts of the container 1 farthest away along the axis C, i.e. upwardly, and the terms "lower" and "bottom" refer to the region or parts of the container 1 furthers away in a direction opposite said upper region along axis C, i.e. downwardly. Axis C is located within a vertical plane of the container 1, whereas axis A and B defines a horizontal plane of the container 1. The container 1 is suitably symmetrical in relation to longitudinal axis B, and in relation to the transverse axis A. The term "inwardly" or "inward" further defines a direction towards the inner side of the container 1, whereas the term "outwardly" or "outward" defines a direction towards the outer side of the container 1, normally in a direction substantially perpendicular to the wall of the container 1. The height of a part is defined as the extension of said part along said vertical axis C.

To improve comfort during handling and transport of the container 1, to provide a more attractive appearance of the container 1, as well as to improve durability of the container 1 by eliminating sharp corners that give raise to stress concentrations, both a first peripheral corner region 30 of the base 2 where said bottom wall 5 is joined to said base flange 16, and a second peripheral corner region 31 of the lid 3 where said top wall 17 is joined to said lid flange 18 are preferably chamfered and/or rounded. Furthermore, the corner regions 46 of the substantially rectangular container 1 as seen from the top are rounded for the same purpose.

Said lid flange 18 is adapted to be attached over and around said base flange 16 to seal said container 1 in a closed state. The lid flange 18 is preferably wrapped over the entire height of the base flange 16 for the purpose of concealing a split line 47 between the base 2 and lid 3. The split line 47 can serve as an indication for children that the closed container 1 can be opened, and thus start prying the container 1. If the split line 47 is concealed however, there is no explicit hint that the container 1 is openable at all. Due to design constraints, the base flange 16 cannot be entirely covered by the lid flange 18. To provide the attachment of the lid flange 18 over the base flange 16, the lid flange 18 and the base flange 16 are dimensioned to allow the lid flange 18 to telescope down over and around the base flange 16.

The portion of the base flange 16 that is not intended to be covered by the lid flange 18 preferably exhibits a larger outer dimension than the portions that are intended to be covered by the lid flange 18. This difference in outer dimension of the base flange 16 results in an external step 11 in the outer surface of the base flange 16, wherein the size of the step 11 in a horizontal direction substantially equals the thickness of the lower portion of the lid flange 18 at these portions. This configuration thus allows the exterior surface of the lid flange 18 to be positioned substantially flush with the exterior surface of the uncovered base flange 16, thus creating a visually attractive container 1 with a unified external surface giving the illusion of a single solid article.

Figure 5:
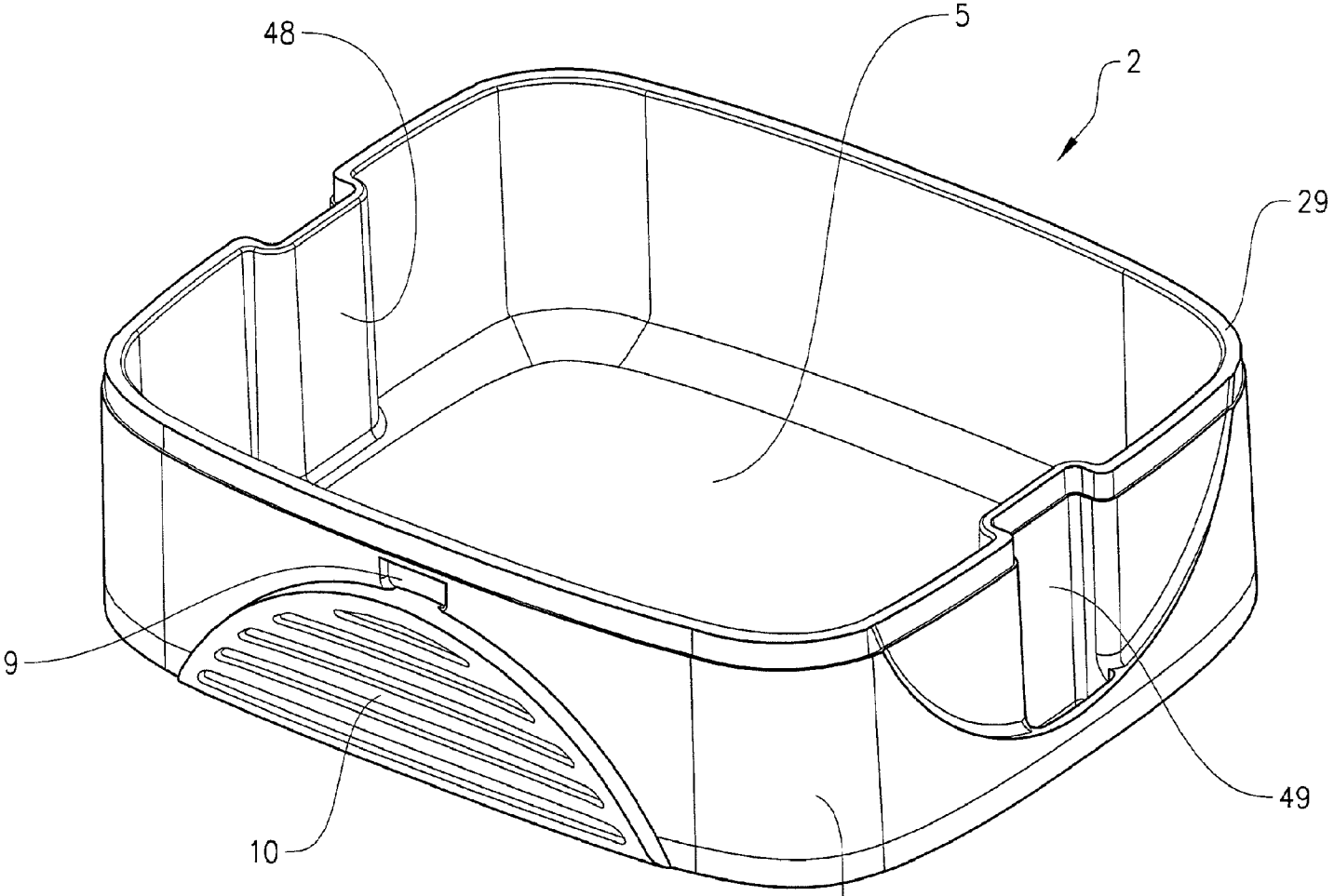
FIG. 5 schematically shows an inside view of the base of the container according to the invention.
Figure 6:
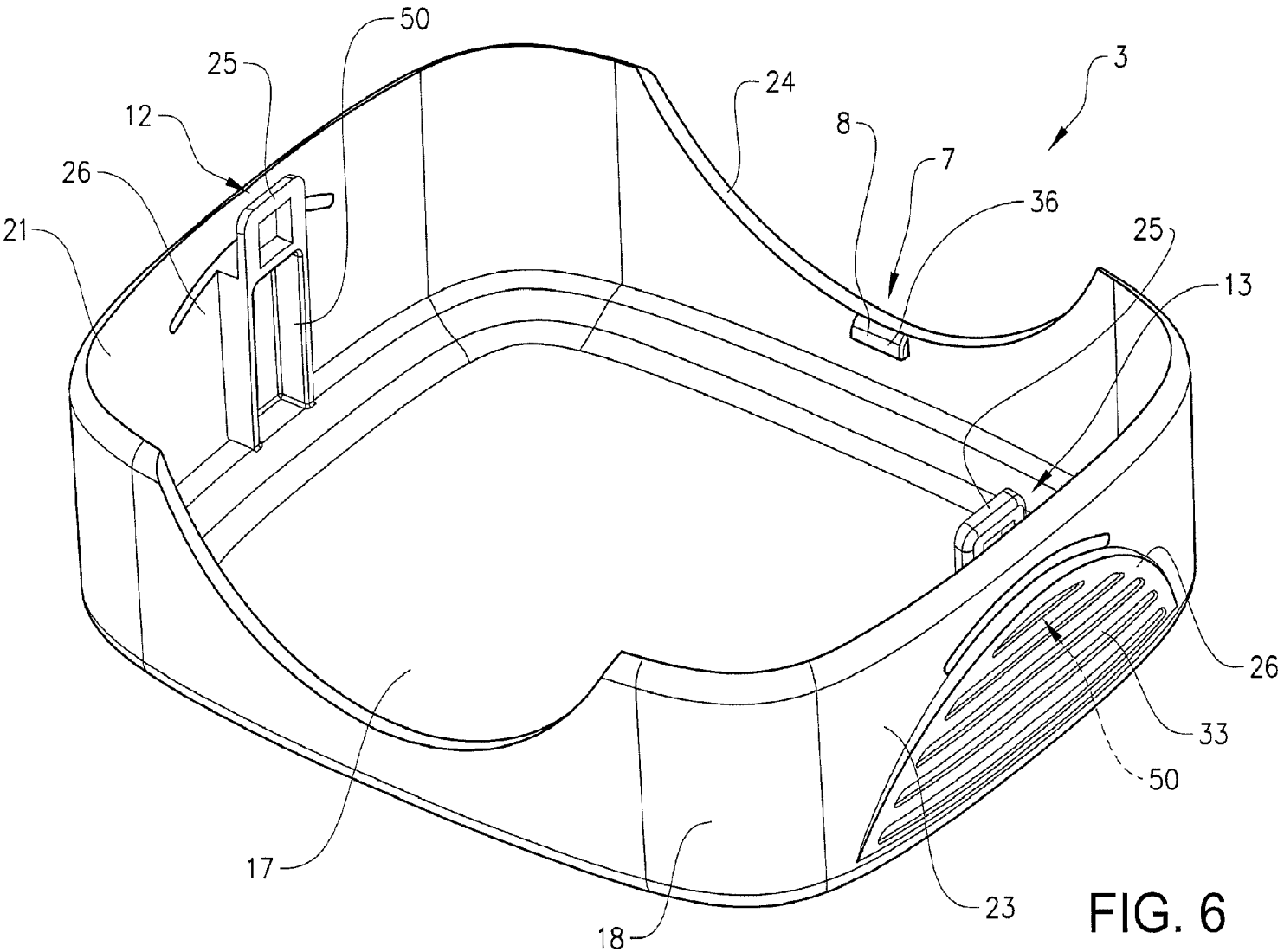
FIG. 6 schematically shows an inside view of the lid of the container according to the invention.

As illustrated in FIGS. 5 and 6, the interior surface of the base flange 16, the bottom wall 5 and the top wall 17 of the lid 3 is preferably smooth and without any sharp steps, or sharp irregularities that may negatively affect the content of the container 1 during transport of removal of content. Each of the internal surfaces of the base flange 16 perpendicular to axis B exhibit a vertically extending rib 48 projecting inwards.

The base 2 and lid 3 are preferably manufactured as single piece mouldings of resilient plastic material such as polypropylene to provide sufficient rigidity for providing adequate child resistance, but also to provide sufficient elasticity to allow being partly compressed and deflected by edgewise squeezing of the closed container 1.

As shown in FIG. 3, the container 1 comprises four releasable latching arrangements 6, 7, 12, 13 divided in a first 6, 7 and a second 12, 13 pair for securing the lid 3 to the base 2 in a positive child resistant manner, wherein said releasable latching arrangements of said first pair 6, 7 are identical and provided on substantially opposite sides of the container 1, and wherein said second pair 12, 13 are identical and also provided on substantially opposite sides of the container 1. The releasable latching arrangements 6, 7, 12, 13 of said first and second pair can all be identical, but it is preferred to design each pair of releasable latching arrangements according the their specific requirements.

The first pair of latching arrangements 6, 7, shown in FIG. 2, 4-7, include latching elements 8 provided on said lid 3, and cooperating latching elements 9 provided on said base 2. The second pair of latching arrangements 12, 13, shown in FIG. 2, 5, 6, 8-11, include latching elements 25 provided on said lid 3, and cooperating latching elements 27 provided on said base 2. The latching elements 8 and cooperating latching elements 9 of the first pair preferably comprise an inwardly directed latching projection and a latching recess respectively, wherein said latching recess is adapted to receive said latching projection. The latching elements 25 and cooperating latching elements 27 of the second pair preferably comprise a latching recess and an inwardly directed latching projection respectively, wherein said latching recess is adapted to receive said latching projection. The second pair of latching arrangement 12, 13 may comprise reinforcement means 50 for reinforcement of the side walls 21, 23 of the lid, as shown in FIGS. 2, 6, 8, 10.

The latching arrangements 6, 7, 12, 13 of each pair are located generally opposite one another on said container 1 to allow release actuation of said latching arrangements 6, 7, 12, 13 by edgewise squeezing of the container 1 between for example the face of the thumb and the forefinger of both of the user's hands. The opposite location of the first and second pair of latching arrangements respectively assure that the force produced by said squeezing will be directed substantially perpendicular to release actuation surfaces 10, 33 of the container 1, thus simplifying actuation and avoiding shear forces on the releasable latching arrangements 6, 7, 12, 13.

To provide sufficient level of child resistance, four latching arrangements 6, 7, 12, 13 are provided, which all must be simultaneously actuated to allow opening of the container 1, and which are spread around the circumference of the container 1 to eliminate any possibility to gain access to the content of the container 1 by the use of only one hand, or by compression of the container 1 over a large surface thereof in a single plane.

The container 1 according to the inventive embodiment has four sides, wherein one latching arrangement 6, 7, 12, 13 is provided on each of said four sides to provide adequate child resistance. An angle $\alpha$ between a first plane 14 passing through the centre of said first pair of releasable latching arrangements 6, 7 and a second plane 15 passing through the centre said second pair of releasable latching arrangements 12, 13, each of said first and second planes being perpendicular to a horizontal plane defined by the bottom wall 5 of said base 2, defines the circumferential spread of said latching arrangements 6, 7, 12, 13. The angle $\alpha$ must be sufficient large to provide the advantages in terms of high child resistance and effortless handling, whilst said angle $\alpha$ might not necessarily be exactly 90° to allow a certain extent of freedom in the design of the container 1 according to the invention, to adapt said container 1 to varying forms and requirements of each specific application. Too small angle $\alpha$, indicating that two releasable latching arrangements are positioned relatively close to each other results in a number of disadvantages. The risk that all four separate releasable latching arrangements can be actuated by a single hand increases. The height of the container 1 will increase provided that the size of release actuation surfaces 10, 33 remain fixed, because the release actuation surfaces 10, 33 would no longer be arranged in an alternate manner along the circumference of the container 1. Manufacturing cost can also increase due to increasingly complex tooling and time consuming moulding when the latching elements 8, and corresponding latching elements 9, 27 are arranged close to each other. Hence, said angle α is selected to be positioned within the range of approximately 70° to approximately 110° to fulfil the requirements of adequate child resistance, freedom of design, and low manufacturing costs. Said angle α is preferably located within the range of approximately 80° to approximately 100° to further increase level of child resistance, more preferably within the range of approximately 85° to approximately 95°, and most preferably approximately 90°, i.e. where the first and second pairs of latching arrangements 6, 7, 12, 13 are located perpendicular to each other in a horizontal plane of the container 1.

Figure 7:
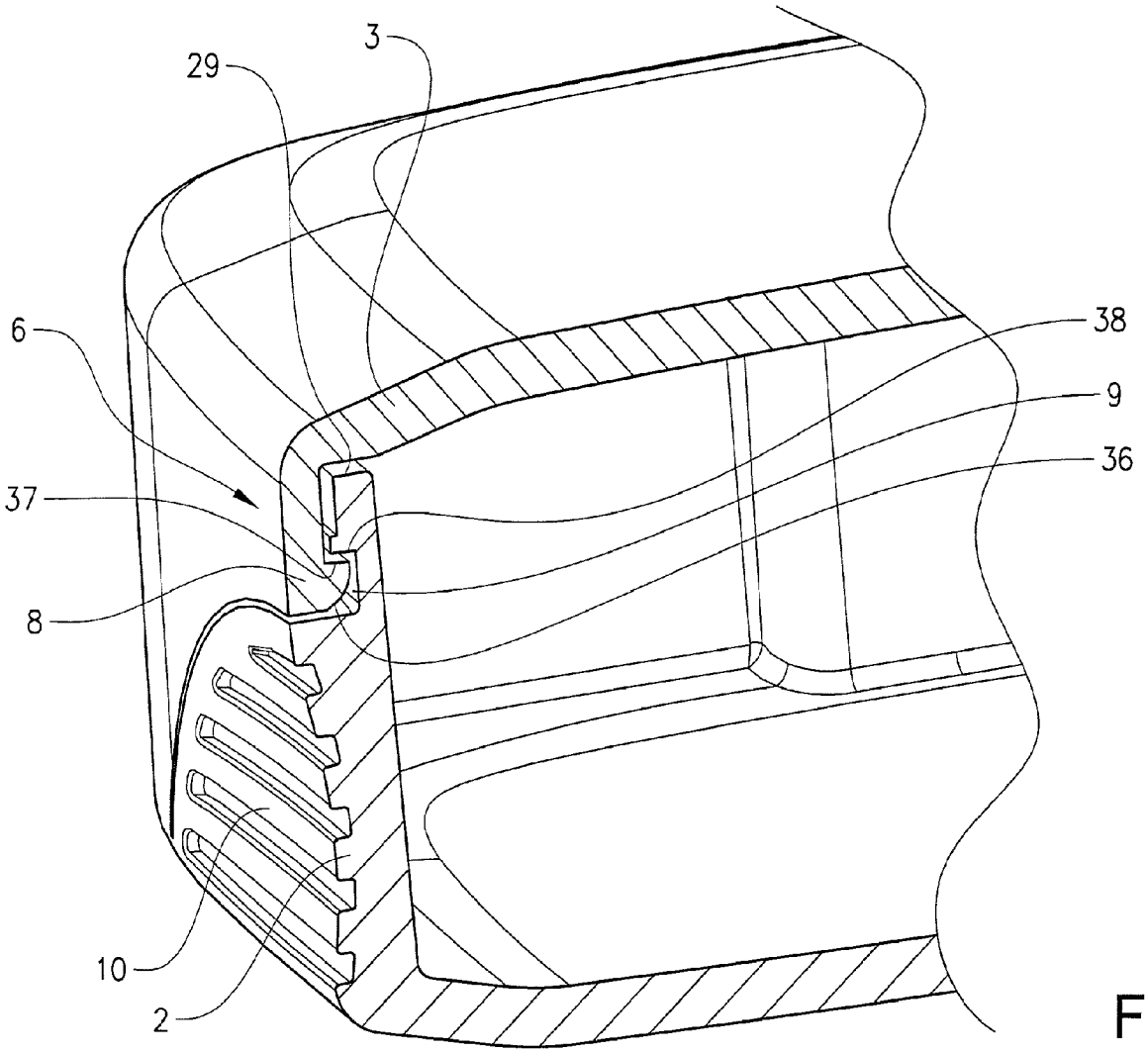
FIG. 7 schematically shows a close up view of the first latching pair when the container is closed.

As best seen in FIGS. 4 and 7 of the disclosed embodiment, the first pair of releasable latching arrangements 6, 7 rely primarily on the elasticity of the base flange 16 to interlock and to release the lid 3 and base 2. The elasticity of the lid flange 18, as well as the design of the latching projections on the lid flange 18 and cooperating latching recesses in the base flange 16 influence to a certain extent the function of the first pair of releasable latching arrangements 6, 7.

During closing of the lid 3, a first cam surface 36 of a latching element 8 of the first pair of latching arrangements 6, 7 engages an upper edge 29 of the base flange 16, and primarily the base flange 16, but also the lid flange 18, will deflect to a certain extent during further closing of the lid 3 in region of the first pair of latching arrangements 6, 7. As the lid 3 finally reaches the fully closed position as illustrated in FIGS. 4 and 7, said latching element 8, in the form of a latching projection, will snap inwardly into the cooperating latching element 9 formed as a recess in the base flange 16. In this position, removal of the lid 3 is prevented by virtue of the fact that a first catch surface 37 of said latching element 8 faces a second catch surface 38 of said cooperating latching element 9. Preferably, said first catch surface 37 and second catch surface 38 are substantially parallel and perpendicular to the direction of removal of the lid 3, or arranged at an angle with respect to the direction of removal to provide a self-locking effect in response to an improper attempt to remove the lid 3.

The cooperating latching elements 9 of the first latching arrangements 6, 7 are located at the centre of the base flange 16 in the longitudinal direction. The inward depth of the latching recesses is restricted not to penetrate the entire wall of the base flange 16, because hermetical sealing of said base 2 by means of a sealing foil might be required, depending on what type of product is stored in the container 1.

As can be seen in FIG. 2, the latching projections of the first pair of latching arrangements 6, 7 are each located at the centre of the lid flange 18 in the longitudinal direction to fully engage with the latching recesses in the closed position. The latching projections have a shape corresponding to the shape of the latching recesses. Preferably, the latching element 8 exhibit a first cam surface 36 for leading the latching elements 8 and the lid flange 18 over and around an upper edge 29 of the base flange 16 during closing of the container 1.

The first pair of latching arrangements 6, 7 can be put in a disengaged state by exerting, on opposite release actuation surfaces 10 on the base flange 16, forces indicated by the arrows D and E in FIG. 3 and of sufficient magnitude to deflect the base flange 16 in the region of the first pair of latching arrangements 6, 7. This opposite forces will tend to deflect the base flange 16 inwardly, such that latching projections of the lid 3 can be moved upwards without striking the second catch surfaces 38 of the cooperating latching element 9. Preferably, such deflection is achieved in response to edgewise squeezing of the closed container 1 between the face of the thumb and the forefinger of one of the users hands. To guide the user, release actuation surfaces 10 are marked with a suitable marking, such as thin notches, ridges, colourings, and the like, indicating the point where forces D and E are to be applied to the closed container 1 in order to insure consistent opening of the container 1.

Figure 8:
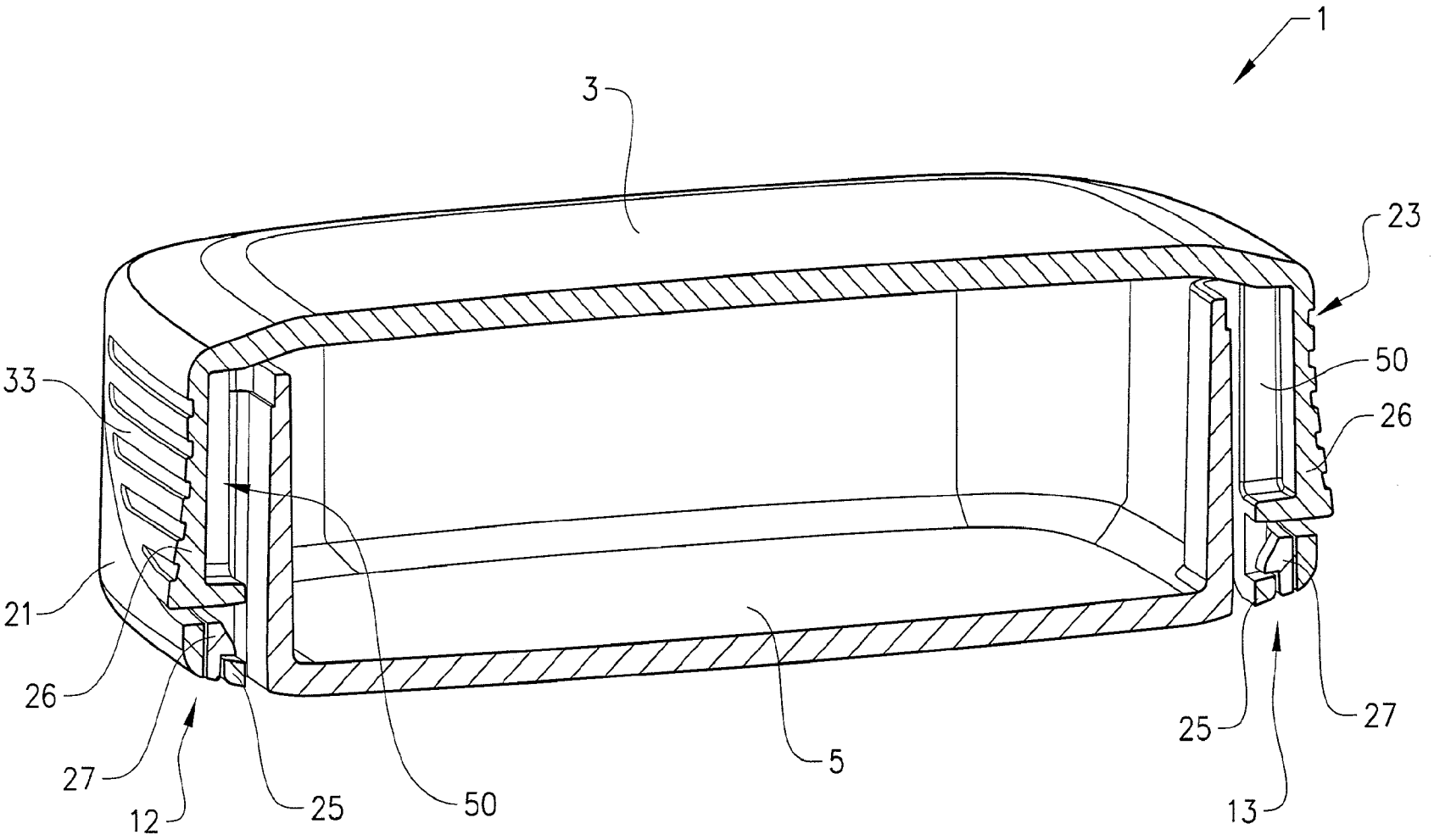
FIG. 8 schematically shows the container closed illustrating the second latching pair.
Figure 9:
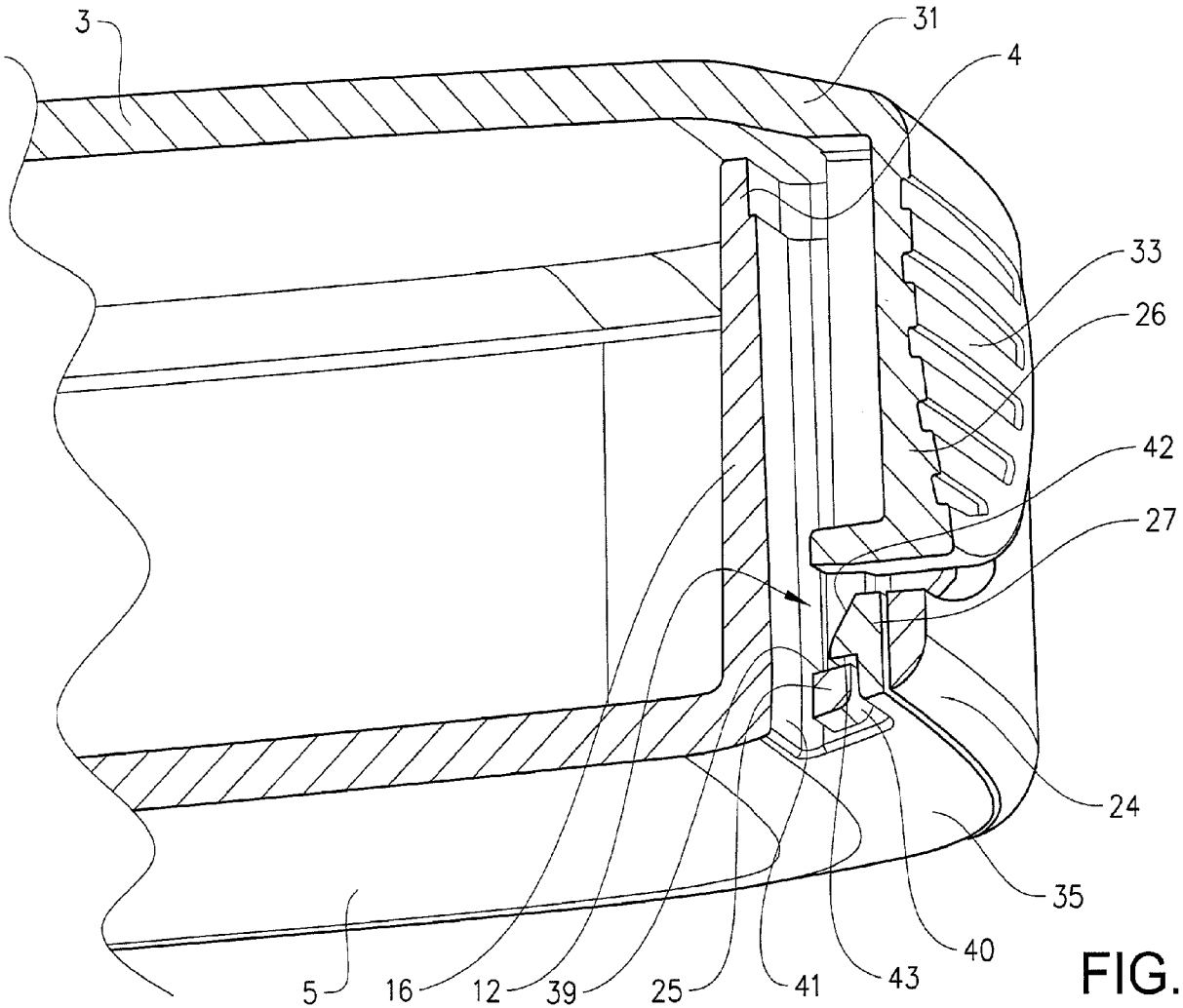
FIG. 9 schematically shows a close up view of the second latching pair when the container is closed.
Figure 10:
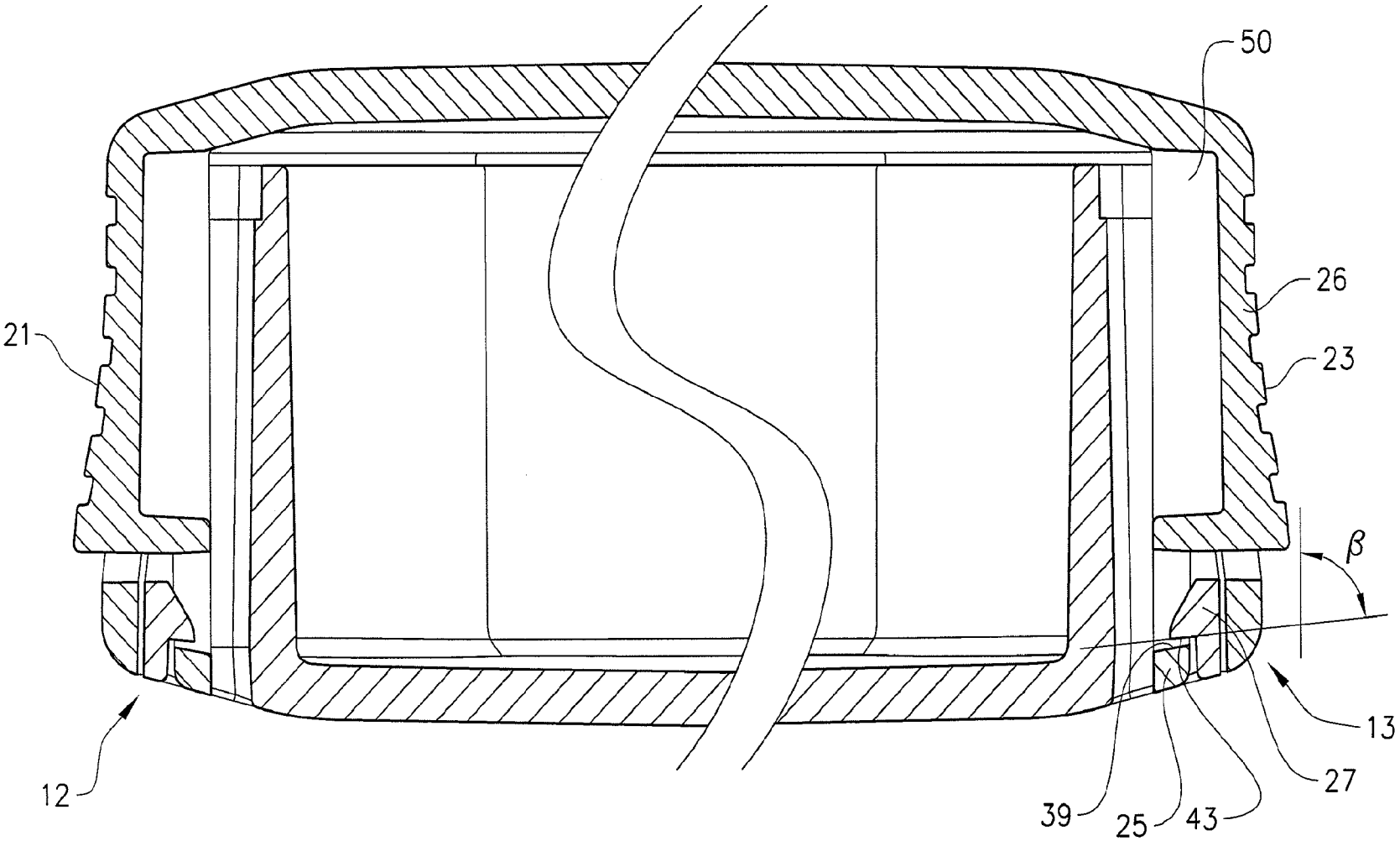
FIG. 10 schematically shows a side view of the container according to the invention further illustrating the arrangement of the second latching pair.

As illustrated in FIG. 8-10, the latching elements 25 of each of the second pair of latching arrangements 12, 13 is formed of a pivotable element 26 attached to the lid 3 to interlock and release the lid 3 and base 2 in cooperation with a cooperating latching projection in the base 2 forming the cooperating latching element 27.

Figure 11:
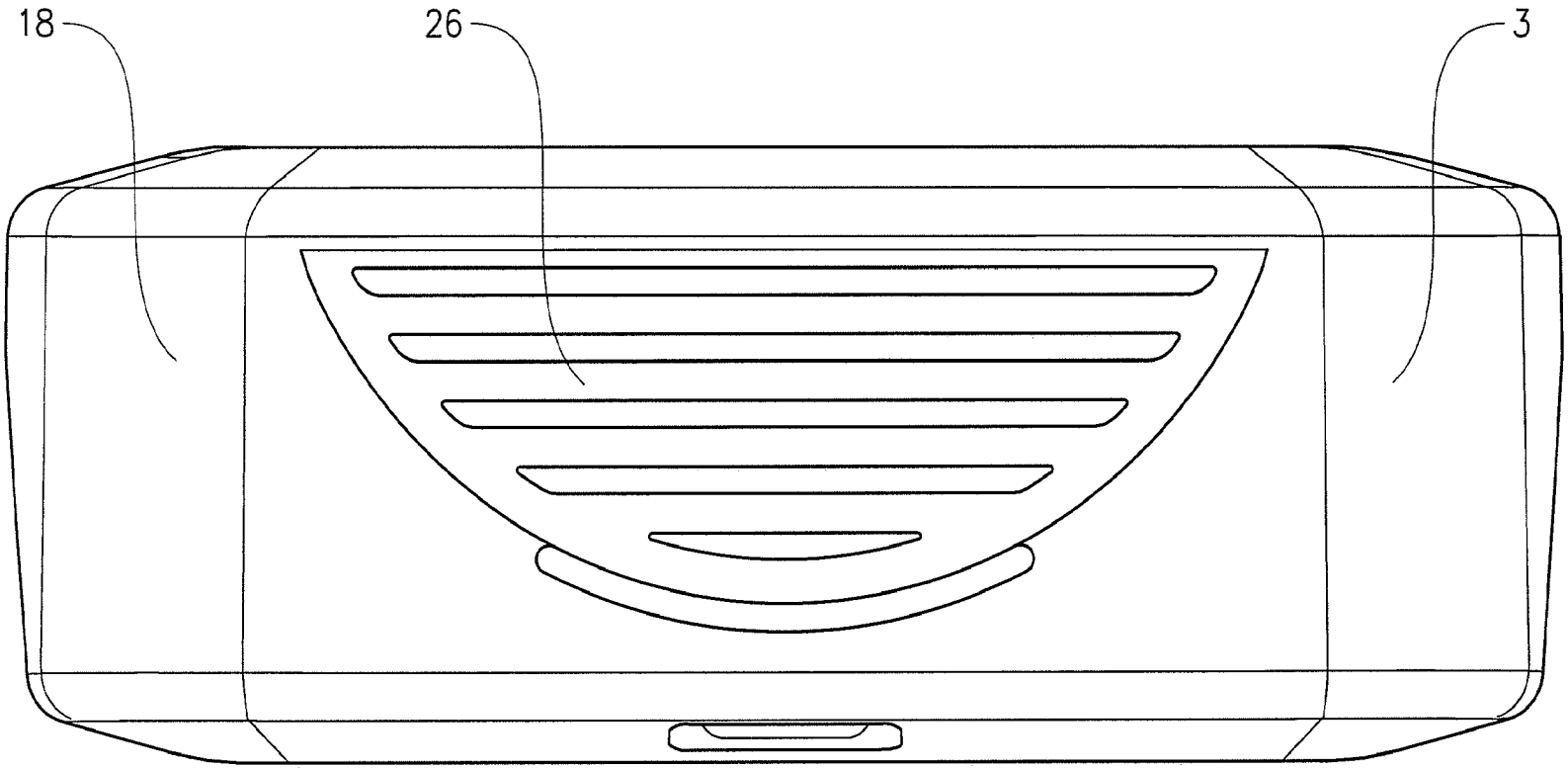
FIG. 11 schematically shows a view of one of the pivotable elements used in connection with the second latching pair.

Shown in FIG. 11 is a front view is of the pivotable element 26, which has substantially the form a circular segment forming part of the lid flange 18, and pivotably attached thereto at least at an upper area of the lid flange 18. The pivotably attachment of the pivotable element 26 allows a certain degree of pivoting movement around a pivoting axis, and said attachment is preferably formed by integrally forming said pivoting element 26 with said lid 3 during moulding of the lid 3, resulting in a single piece moulded in plastic. By forming a slit along the curved surface of the circle segment, the pivoting element 26 is attached mainly by means of a living hinge to the rest of the lid flange 18. Said living hinge is arranged horizontally in the disclosed embodiment of the container 1, but the invention is equally applicable with said living hinge arranged in any another orientation in the plane of the lid flange 18, and the area of attachment of the pivoting element 26 is also not limited to the upper area of the lid flange 18.

The release actuation surface 33 of each of the latching elements 25 of the second pair of latching arrangements 12, 13 is defined as the surface of the pivotable element 26 which, when a certain force is applied to that surface, leads to a pivoting motion of the pivotable element 26. In practice, this means the entire surface of the pivoting element 26 below the area of attachment.

Each of the latching elements 25 of the second pair of latching arrangements 12, 13 include a cantilever beam attached to a lower portion of the pivotable element 26. The cantilever beam can preferable extend further down below the pivoting element 26 for simplifying attachment of the cantilever beam to the pivotable element 26. The cantilever beam can preferably also be displaced inwardly with respect to the pivotable element 26, for example by means of L-shaped cantilever beam, because such an arrangement allows the outer surface of the pivotably element 26 to be arranged almost flush with the remaining outer surface of the lid flange 18. The cantilever beam is provided with a first cam surface 40 of latching element 25 and a first catch surface 39 of latching element 25.

Each of the corresponding latching elements 27 of the second pair of latching arrangements 12, 13 include a second cam surface 42 and a second catch surface 43. In the embodiment shown in FIG. 8-10, the second cam surface 42 faces inwards and the first cam surface 40 faces outwards, but this is not to interpreted as limiting of the invention. These cam surfaces can cooperate in any other direction. Furthermore, it is sufficient that only the latching element 25 or the cooperating latching element 27 is provided with a cam surface to simplify automatic latching when lid 3 is pushed down onto base 2.

During closing of the lid 3, the first cam surface 40 of the second pair of latching arrangements 12, 13 engage the second cam surface 42, and as a consequence thereof, the pivotable element 26 will be forced to pivot inwardly to allow the first cam surface 40 to pass the second cam surface 42. During further closing of the lid 3, the lid 3 finally reaches the fully closed position, where said latching element 25 will snap into the corresponding latching element 27. In this position, removal of the lid 3 is prevented by virtue of the fact that the first latching surface 39 of the latching element 25 faces the second latching surface 43 of the corresponding latching element 27. Preferably, said first and second latching surfaces 39, 43 of the second latching arrangements 12, 13 are substantially parallel, and arranged at an angle β with respect to a direction of removal to provide a self-locking effect in response to an improper attempt to remove the lid 3. The direction of removal is considered to be parallel with vertical axis C, and the angle β is preferably ≤85 degrees, and more preferably ≤80 degrees.

The latching elements 25 of the second pair of latching arrangements 12, 13 are arranged at an end of a vertical cantilever beam, which is provided with a central aperture at the lower end thereof. The aperture is arranged to receive the cooperating latching element 27 in the closed position of the container 1. The cooperating latching element 27 comprises the second cam surface 42 and the second latch surface 43, and is arranged on an extension 35 of the bottom wall 5, which extension 35 protrudes in a longitudinal direction external from the base flange 16. An aperture 41 is also provided in said extension 35 in a centre thereof for getting access to in particular the second catch surface 43 of the cooperating latching element 27 from below the container 1, thus simplifying manufacturing thereof. The external side of the vertically extending rib 48 form a channel 49 for allowing the latching element 25 to project inwardly when the release actuation surface 33 is pressed inwardly to disengage the second pair of latching arrangement 12, 13.

The second pair of latching arrangements 12, 13 is put in a disengaged state by exerting, on opposite release actuation surfaces 33 of the pivotable elements 26, forces indicated by the arrows F and G in FIG. 3 and of sufficient magnitude to pivot the pivotable element 26, such that latching element 25 can be moved upwards without striking the second latching surface 43 of the corresponding latching element 27. Preferably, the pivotable motion of the pivotable elements 26 are achieved in response to edgewise squeezing of the closed container 1 between the face of the thumb and the forefinger of the other of the users hands. To guide the user, the release actuation surfaces 33 can be marked with a suitable marking, such as thin notches, ridges, colourings, and the like, indicating the surface area where forces F and G can be successfully applied to the closed container 1 in order to assure consistent opening of the container 1.

By providing the release actuation surfaces 10 of said first pair of latching arrangements 6, 7 on said base flange 16, and said release actuation surfaces 33 of said second pair of latching arrangements 12, 13 on said lid flange 18, opening of the container 1 is simplified, since both the required inward directed actuation force of said latching arrangements 6, 7, 12, 13, as well as the required vertical separation force surmounting the contact friction between the base flange 16 and lid flange 18 in their telescoped and closed configuration can be provided by the thumb and forefinger of the user's two hands. Hence, the container 1 can be opened by the two hands of a user despite the significant number of latching arrangements 6, 7, 12, 13.

It will be apparent from the foregoing that the container 1 contemplated by the present invention is child-proof, that the lid is held positively against opening in the normal way either by an adult or a child, that access to the container 1 contents cannot be gained by the application of any combinations of the forces within the strength capabilities and expected dexterity of a, for example, four year old child. However, by means of edgewise squeezing of the closed container 1 with sufficient force by a normal adult using two hands, the container lid may be released and removed to open the container 1.

The container 1 is preferably provided with a foil seal (not shown) attached to the upper edge 29 of the base flange 16 for hermetical sealing of said base 2. This is required when the content of the container 1 is sensitive to air and moisture, and when food packing regulations must be satisfied. The foil seal is preferably made of aluminium or an aluminium composite, such as aluminium and polyester. The foil seal is removed before use of the content for the first time. When selecting the type of latching arrangements to use with the invention, it is thus important to provide cooperating latching elements 25, 27 of the first and second pairs of latching arrangements 6, 7, 12, 13 that do not negatively influence the sealing performance of the container 1, i.e. that allow any air or moisture etc. to pass into the sealed content of the container 1.

According to the inventive embodiment, the latching element is formed as a latching projection and the corresponding latching element as a latching recess. The invention is however equally applicable with the latching projection located on the base flange and with the latching recess located on the lid flange, or where the latching element and corresponding latching element have another form, such as spring fingers, latching tongues, or the like. The invention has further been described with two different pairs of latching arrangements, but the invention is equally applicable using the same type of latching arrangement at all four locations, or with three latching arrangements of a first type and a single latching arrangement of second type.

As will be realised, the invention is capable of modification in various obvious respects, all without departing from the scope of the appended claims. Accordingly, the drawings and the description thereto are to be regarded as illustrative in nature, and not restrictive.

Table of references

| | |
|---|---|
| 1 | Container |
| 2 | Base |
| 3 | Lid |
| 4 | Upper portion |
| 5 | Bottom wall of base |
| 6, 7 | First pair of releasable latching arrangements |
| 8, 25 | Latching element |
| 9, 27 | Cooperating latching element |
| 10, 33 | Release actuation surface |
| 11 | Circumferential step of base flange |
| 12, 13 | Second pair of releasable latching arrangements |
| 14 | First plane |
| 15 | Second plane |
| 16 | Base flange |
| 17 | Top wall |
| 18 | Lid flange |
| 20-23 | Side walls of container |
| 24 | End of lid flange |
| 26 | Pivotable element |
| 29 | Upper edge of base flange |
| 30 | First peripheral corner region |
| 31 | Second peripheral corner region |
| 34 | Third plane |

-continued

| Table of references | |
|---|---|
| 35 | Extension of bottom wall |
| 36 | First cam surface of latching element 8 |
| 37 | First catch surface of latching element 8 |
| 38 | Second catch surface of cooperating latching element 9 |
| 39 | First catch surface of latching element 25 |
| 40 | First cam surface of latching element 25 |
| 41 | Aperture |
| 42 | Second cam surface of cooperating latching element 27 |
| 43 | Second catch surface of cooperating latching element 27 |
| 46 | Corner region |
| 47 | Split line |
| 48 | Rib |
| 49 | Channel |
| 50 | Reinforcement means |

The invention claimed is:

1. A child resistant container for tobacco or a tobacco substitute product comprising:

a base that comprises a bottom wall and a peripheral base flange extending from said bottom wall;

a detachable and re-attachable separate lid comprising a top wall and a peripheral lid flange extending from said top wall, wherein said peripheral lid flange is adapted to be attached over and around at least an upper portion of said peripheral base flange;

a first pair of releasable latching arrangements and a second pair of releasable latching arrangements, wherein each of said releasable latching arrangements comprises a latching element, a cooperating latching element, and a release actuation surface, wherein said release actuation surface of each of said first pair of latching arrangements is provided on said peripheral base flange, and said release actuation surface of each of said second pair of latching arrangements is provided on said peripheral lid flange, wherein said latching element of each of said second pair of latching arrangements comprises at least one pivotable element integrally attached along an upper portion of said peripheral lid flange, and wherein said peripheral lid flange comprises a slit along a portion of said pivotable element, and wherein said latching elements are adapted to interlock with said cooperating latching elements when said lid is pushed onto said base to retain said lid to said base, wherein said latching elements are further adapted to disengage from said cooperating latching elements when an inward force is exerted on said release actuation surfaces; and wherein only said actuation surfaces of said first pair of latching arrangements are visible and the rest of said peripheral base flange is concealed by said peripheral lid flange when said child resistant container is closed.

2. The child resistant container of claim 1, wherein simultaneous force exerted on all of said releasable latching arrangements by at least four fingers of a user is required to open said child resistant container.

3. The child resistant container of claim 1, wherein said first pair of releasable latching arrangements is arranged on substantially opposite sides of said child resistant container, wherein said second pair of releasable latching arrangements is arranged on substantially opposite sides of said container, and wherein an angle ($\alpha$) between a first plane passing through said first pair of releasable latching arrangements and a second plane passing through said second pair of releasable latching arrangements, each of said planes being perpendicular to a third plane defined by said bottom wall, is within the range of 70° to 110°.

4. The child resistant container of claim 3, wherein said angle ($\alpha$) is within the range of 80° to 100°.

5. The child resistant container of claim 3, wherein said angle ($\alpha$) is within the range of 85° to 95°.

6. The child resistant container of claim 3, wherein said angle ($\alpha$) is 90°.

7. The child resistant container of claim 1, wherein said peripheral lid flange, said peripheral base flange, and the location of said release actuation surfaces are adapted such that said peripheral lid flange and said peripheral base flange will at least partly deform inwardly upon inward force exerted on said release actuation surfaces, resulting in disengagement of said latching elements from said cooperating latching elements.

8. The child resistant container of claim 1, wherein said slit comprises a circular or elliptical shape.

9. The child resistant container of claim 1, wherein said peripheral base flange and said peripheral lid flange have a rectangular configuration defining four side walls of said child resistant container, wherein one of said releasable latching arrangements is provided on each of said side walls.

10. The child resistant container of claim 1, wherein said latching elements of each of said second pair of releasable latching arrangements is formed as a snap-latch cantilever beam arranged at a lower portion of said pivotable element.

11. The child resistant container of claim 10, wherein each of said snap-latch cantilever beams comprises a first catch surface adapted to interlock with a second catch surface of said cooperating latching element, and wherein said second pair of releasable latching arrangements are self-locking.

12. A child resistant container for tobacco or a tobacco substitute product comprising:

a base that comprises a bottom wall and a peripheral base flange extending from said bottom wall;

a detachable and re-attachable separate lid comprising a top wall and a peripheral lid flange extending from said top wall, wherein said peripheral lid flange is adapted to be attached over and around at least an upper portion of said peripheral base flange;

a first pair of releasable latching arrangements and a second pair of releasable latching arrangements, wherein each of said releasable latching arrangements comprises a latching element, a cooperating latching element, and a release actuation surface, wherein said release actuation surface of each of said first pair of latching arrangements is provided on said peripheral base flange, and said release actuation surface of each of said second pair of latching arrangements is provided on said peripheral lid flange, wherein said latching element of each of said second pair of latching arrangements comprises at least one pivotable element integrally attached along an upper portion of said peripheral lid flange, and wherein said peripheral lid flange comprises a slit along a portion of said pivotable element, wherein said latching elements are adapted to interlock with said cooperating latching elements when said lid is pushed onto said base to retain said lid to said base, wherein said latching elements are further adapted to disengage from said cooperating latching elements when an inward force is exerted on said release actuation surfaces, wherein said latching elements are located on said lid flange, wherein said latching elements of said first pair of latching arrangements are inwardly directed latching projections, wherein said latching elements of said second pair of latching arrangements are latching recesses, wherein said cooperating latching elements are located on said peripheral base flange or on said bottom wall, wherein said cooperating latching elements of said first pair of latching arrangements are latching recesses, and wherein said cooperating latching elements of said second pair of latching arrangements are inwardly directed latching projections.

13. The child resistant container of claim 12, wherein simultaneous force exerted on all of said releasable latching arrangements by at least four fingers of a user is required to open said child resistant container.

14. A child resistant container for tobacco or a tobacco substitute product comprising:

a base that comprises a bottom wall and a peripheral base flange extending from said bottom wall;

a detachable and re-attachable separate lid comprising a top wall and a peripheral lid flange extending from said top wall, wherein said peripheral lid flange is adapted to be attached over and around at least an upper portion of said peripheral base flange;

a first pair of releasable latching arrangements and a second pair of releasable latching arrangements, wherein each of said releasable latching arrangements comprises a latching element, a cooperating latching element, and a release actuation surface, wherein said first pair of latching arrangements are of a different structure or shape than said second pair of latching arrangements, wherein said release actuation surface of each of said first pair of latching arrangements is provided on said peripheral base flange, and said release actuation surface of each of said second pair of latching arrangements is provided on said peripheral lid flange, wherein each latching element of said first pair of releasable latching arrangements is formed as at least one latching projection arranged on an inner side of said peripheral lid flange, and each cooperating latching element of said first pair of releasable latching arrangement is formed as at least one latching recess arranged in said peripheral base flange, wherein said peripheral base flange and the location of said release actuation surfaces of said first pair of latching arrangements are adapted such that said peripheral base flange will at least partly deform inwardly upon inward force exerted on said release actuation surfaces, resulting in disengagement of said latching elements from said cooperating latching elements of said first pair of latching arrangements, wherein said latching elements are adapted to interlock with said cooperating latching elements when said lid is pushed onto said base to retain said lid to said base, wherein said latching elements are further adapted to disengage from said cooperating latching elements when an inward force is exerted on said release actuation surfaces.

15. The child resistant container of claim 14, wherein simultaneous force exerted on all of said releasable latching arrangements by at least four fingers of a user is required to open said child resistant container.

16. The child resistant container of claim 14, wherein said first pair of releasable latching arrangements is arranged on substantially opposite sides of said child resistant container, wherein said second pair of releasable latching arrangements is arranged on substantially opposite sides of said container, and wherein an angle ($\alpha$) between a first plane passing through said first pair of releasable latching arrangements and a second plane passing through said second pair of releasable latching arrangements, each of said planes being perpendicular to a third plane defined by said bottom wall, is within the range of 70° to 110°.

17. The child resistant container of claim 16, wherein said angle ($\alpha$) is within the range of 80° to 100°.

18. The child resistant container of claim 16, wherein said angle ($\alpha$) is within the range of 85° to 95°.

19. The child resistant container of claim 16, wherein said angle ($\alpha$) is 90°.

20. The child resistant container of claim 14, wherein said peripheral base flange and said peripheral lid flange have a rectangular configuration defining four side walls of said child resistant container, wherein one of said releasable latching arrangements is provided on each of said side walls.

21. The child resistant container of claim 14, wherein said latching elements of each of said second pair of releasable latching arrangements is formed as a snap-latch cantilever beam arranged at a lower portion of said pivotable element.

22. The child resistant container of claim 21, wherein each of said snap-latch cantilever beams comprises a first catch surface adapted to interlock with a second catch surface of said cooperating latching element, and wherein said second pair of releasable latching arrangements are self-locking.

23. The child resistant container of claim 14, wherein only said actuation surfaces of said first pair of latching arrangements are visible and the rest of said peripheral base flange is concealed by said peripheral lid flange when said child resistant container is closed.

24. A child resistant container for tobacco or a tobacco substitute product comprising:

a base that comprises a bottom wall and a peripheral base flange extending from said bottom wall;

a detachable and re-attachable separate lid comprising a top wall and a peripheral lid flange extending from said top wall, wherein said peripheral lid flange is adapted to be attached over and around at least an upper portion of said peripheral base flange;

a first pair of releasable latching arrangements and a second pair of releasable latching arrangements, wherein each of said releasable latching arrangements comprises a latching element, a cooperating latching element, and a release actuation surface, wherein said first pair of latching arrangements are of a different structure or shape than said second pair of latching arrangements, wherein said release actuation surface of each of said first pair of latching arrangements is provided on said peripheral base flange, and said release actuation surface of each of said second pair of latching arrangements is provided on said peripheral lid flange, wherein said latching elements of each of said second pair of releasable latching arrangements is formed as a snap-latch cantilever beam arranged at a lower portion of a pivotable element, wherein said snap-latch cantilever beams are arranged to engage cooperating latching elements provided on an extension of the bottom wall, which extension protrudes in a longitudinal direction external from said peripheral base flange, wherein an inward force exerted on said release actuation surface of each of said second pair of latching arrangements will cause said pivotable element to pivot inwardly, resulting in disengagement of said latching element from said cooperating latching element, wherein said latching elements are adapted to interlock with said cooperating latching elements when said lid is pushed onto said base to retain said lid to said base, wherein said latching elements are further adapted to disengage from said cooperating latching elements when an inward force is exerted on said release actuation surfaces; and wherein an aperture is provided in said extension in a centre thereof for enabling access to the cooperating latching element from below the container.

25. The child resistant container of claim 24, wherein each of said snap-latch cantilever beams comprises a first catch surface adapted to interlock with a second catch surface of said cooperating latching element, and wherein said second pair of releasable latching arrangements are self-locking.

26. A child resistant container for tobacco or a tobacco substitute product comprising:

a base that comprises a bottom wall and a peripheral base flange extending from said bottom wall;

a detachable and re-attachable separate lid comprising a top wall and a peripheral lid flange extending from said top wall, wherein said peripheral lid flange is adapted to be attached over and around at least an upper portion of said peripheral base flange;

a first pair of releasable latching arrangements and a second pair of releasable latching arrangements, wherein each of said releasable latching arrangements comprises a latching element, a cooperating latching element, and a release actuation surface, wherein said first pair of latching arrangements are of a different structure or shape than said second pair of latching arrangements, wherein said release actuation surface of each of said first pair of latching arrangements is provided on said peripheral base flange, and said release actuation surface of each of said second pair of latching arrangements is provided on said peripheral lid flange, wherein said latching elements of each of said second pair of releasable latching arrangements is formed as a snap-latch cantilever beam arranged at a lower portion of a pivotable element, wherein said snap-latch cantilever beams are arranged to engage cooperating latching elements provided on an extension of the bottom wall, which extension protrudes in a longitudinal direction external from said peripheral base flange, wherein an inward force exerted on said release actuation surface of each of said second pair of latching arrangements will cause said pivotable element to pivot inwardly, resulting in disengagement of said latching element from said cooperating latching element, wherein said latching elements are adapted to interlock with said cooperating latching elements when said lid is pushed onto said base to retain said lid to said base, wherein said latching elements are further adapted to disengage from said cooperating latching elements when an inward force is exerted on said release actuation surfaces, and wherein each of the cooperating latching elements of the second pair of latching arrangements include a cam surface that faces inwards.

27. The child resistant container of claim 26, wherein each of said snap-latch cantilever beams comprises a first catch surface adapted to interlock with a second catch surface of said cooperating latching element, and wherein said second pair of releasable latching arrangements are self-locking.

* * * * *